US008997612B2

(12) United States Patent
Andrade

(10) Patent No.: US 8,997,612 B2
(45) Date of Patent: Apr. 7, 2015

(54) MOHAWK HAIR CUTTING GUIDE

(71) Applicant: Michael Steven Andrade, Santa Barbara, CA (US)

(72) Inventor: Michael Steven Andrade, Santa Barbara, CA (US)

( * ) Notice: Subject to any disclaimer, the term of this patent is extended or adjusted under 35 U.S.C. 154(b) by 0 days.

(21) Appl. No.: 13/950,230

(22) Filed: Jul. 24, 2013

(65) Prior Publication Data

US 2015/0027281 A1 Jan. 29, 2015

(51) Int. Cl.
*A45D 24/36* (2006.01)
*B26B 19/38* (2006.01)

(52) U.S. Cl.
CPC ..... *A45D 24/36* (2013.01)

(58) Field of Classification Search
CPC ..... B45D 27/42; B45D 24/36; B26B 19/00; B26B 19/38; B26B 19/3806; B26B 19/3813; B26B 19/3826; B26B 19/48
USPC ..... 30/195–201, 233, 233.5, 229, 231; 132/212, 213, 214; 83/13
See application file for complete search history.

(56) References Cited

U.S. PATENT DOCUMENTS

| | | | | | |
|---|---|---|---|---|---|
| 2,765,797 | A * | 10/1956 | Potente | ..... | 132/213 |
| 3,055,376 | A * | 9/1962 | Walls | ..... | 132/213 |
| 3,115,143 | A * | 12/1963 | Queen | ..... | 132/213 |
| 5,865,192 | A * | 2/1999 | Sealy | ..... | 132/214 |
| 8,826,922 | B1 * | 9/2014 | Lewis | ..... | 132/214 |
| 2004/0074511 | A1 * | 4/2004 | Sussan | ..... | 132/214 |
| 2009/0173357 | A1 * | 7/2009 | Bonge | ..... | 132/214 |

* cited by examiner

*Primary Examiner* — Phong Nguyen

(57) ABSTRACT

A hair cutting guide and method for aiding in creating/trimming a human hair into a Mohawk type hairstyle. The Mohawk guide consists of two side pieces, two adjustable spacers/connectors, and two clips. The bottom edges of the two side pieces are contoured to follow the shape of the human head from the start of the hairline to the nape of the neck.

6 Claims, 7 Drawing Sheets

MOHAWK HAIR CUTTING GUIDE

CROSS-REFERENCE TO RELATED APPLICATIONS

This application is a non-provisional application which claims priority to U.S. provisional application Ser. No. 61/741,565, filed Jul. 24, 2012, which is incorporated by reference herein in its entirety.

BACKGROUND

The present invention is in the field of hair cutting/styling for humans. More particularly, the present invention relates to a hair cutting guide/apparatus which is used to assist in creating a mohawk type hairstyle. A mohawk type hairstyle is most commonly described as a hairstyle wherein both sides of the head are shaved/trimmed, leaving a strip of noticeably longer hair in the center. The strip of hair may vary in width and most commonly runs lengthwise along the head from the top of the forehead (start of hairline) to the back of the neck (end of hairline).

People who want/have a mohawk type hairstyle often find it difficult to get and/or maintain a mohawk. The task of getting and/or maintaining a mohawk generally consist of having your hair cut by a barber, a friend or doing it yourself. Using a barber is expensive and inconvenient considering that you must pay for and go for the initial mohawk haircut and the relatively frequent appointments for touch ups that are required to maintain a mohawk hairstyle. Maintaining a mohawk hairstyle requires frequent touch-ups because the desired look calls for the hair on either side of the mohawk to shaven or trimmed short to create the contrast between the mohawk and the sides of the head. If you have a friend assist in cutting/maintaining your mohawk, typically with a electric buzzer/clipper, it is inconvenient and often results in a poor quality mohawk. The mohawk will likely be crooked/wavy and the width will likely be inconsistent. Moreover, cutting your own hair into a mohawk and/or maintaining your own mohawk, without the guide/apparatus of the present invention, is difficult and likely that the mohawk will not be straight or have a consistent width as well. Therefore, a need remains for a guide/apparatus and method that will assist with creating a professional looking mohawk type hairstyle, particularly without necessitating outside help. The presently described embodiments address this need.

SUMMARY

The mohawk cutting guide/apparatus assists in creating and/or touching-up a quality mohawk type hairstyle quickly, easily and inexpensively. The mohawk guide of the present invention consists of two substantially vertical and parallel sides connected through the middle by an adjustable spacer and/or spacers. The adjustable spacer(s) along with the combined thickness of the two side pieces will determine the width of the mohawk to be cut. The space between the outer side walls of the two vertical sides will constitute the approximate width of the mohawk. The length of the spacer(s) will be adjustable so the guide will be able to create various mohawk widths. The clip(s) and spacer(s) will be located within the outer surfaces of the two side pieces. Outer surfaces of the side pieces will each be flush and serve as a guide for hair cutting implement to be used to cut the hair on either side of the mohawk guide.

The bottoms of the two side pieces are contoured (crescent shaped) to better follow the contour of the human head during operation. This includes a more subtle upward curve near the back ends of the bottom contours of the side pieces which serves to help prevent irritation during operation when the mohawk guide reaches the transition from the head and the nape of the neck while being slid into position for what is generally the last step of the hair cutting process. The inside surfaces/walls of each of the two side pieces have a clip which is designed to grip the hair between the inner surfaces of the two side pieces and the bottom clip edges. I envision the mohawk guide will utilize spring loaded clips to grip the hair so the hair cutting guide is secure and held in place as the hair on either side of the guide is cut during operation.

To use the mohawk guide one would manually hold the spring clips open and slide the guide through their hair (along the scalp) until the front of the guide is at the top of their forehead (start of hairline). I envision the clip(s) will be designed to open either with two hands or one hand. The top of the clip(s) serves as the handle for the mohawk guide during placement before the hair is cut. Once the guide is in the desired position the user would release the clip(s) which via spring power would cause the clip(s) to close thereby gripping the hair in between the bottom clip edges and the inner surface of the two side pieces. Once the guide is clipped on to the hair in the middle of the guide and therefore held securely in place on ones head (clipped onto what will become or already is the mohawk) one can see in a mirror if it's aligned/positioned properly (most commonly positioned along the middle of the head) and if the width is satisfactory. If the user likes the position and width then they would cut the hair on either side of the Mohawk guide. I envision that the outer wall of the two vertical side pieces will be flat so when one cuts the hair nearest the outer surface walls of the guide their hand and hair cutting implement (e.g. clipper, razor) will be unobstructed during cutting. After the hair on either side of the guide is cut to the end of the guide then one would open the clip(s) and slide the guide back until the front of the guide reaches approximately where the end of the guide was during the first cutting step (the end of the first completed mohawk segment) then one would release the clip(s) again securing the guide to hair in between the two side pieces. This process is repeated until the entire mohawk is completed (number of steps depends on head shape/size but is generally three or four). The guide is designed to easily slide through the hair with minimal resistance from the two vertical guide walls, the spacer(s) and the open clips. With the mohawk guide of the present invention one can create a professional looking mohawk and/or touch up an existing mohawk by themselves or with someone else quickly, easily and inexpensively.

BRIEF DESCRIPTION OF THE DRAWINGS

FIG. 14 shows the mohawk guide embodiment in the starting position before/during the first step of operation wherein the guide is clipped onto ones hair with the front of the guide at approximately the start of the hairline and the hair on either side of the guide is cut.

FIG. 15 shows the mohawk guide embodiment in position before/during the second step of operation wherein the guide is clipped onto ones hair with the front of the guide at approximately where the end of the guide was during the previous step and then the hair on either side of the guide is cut.

FIG. 16 shows the mohawk guide embodiment in position before/during the third step of operation wherein the guide is clipped onto ones hair with the front of the guide at approximately where the end of the guide was during the previous step and then the hair on either side of the guide is cut.

DETAILED DESCRIPTION OF THE EMBODIMENTS

Figure 1:
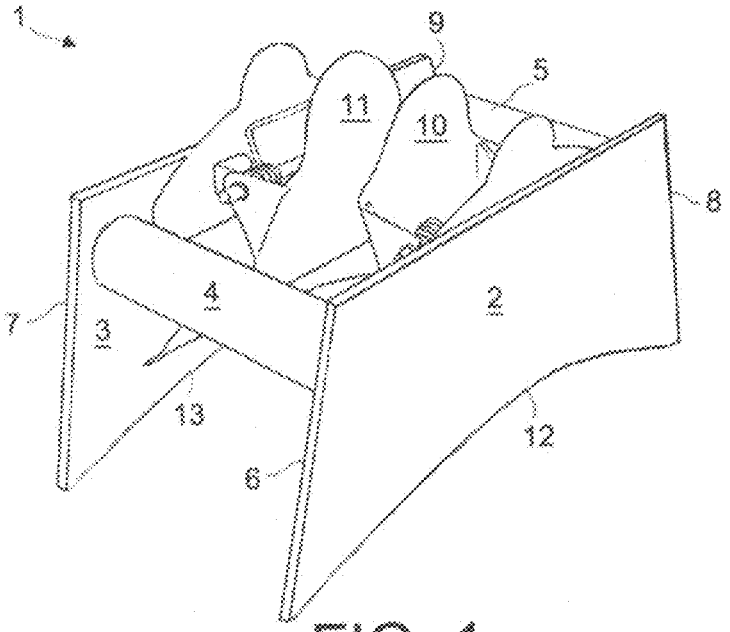
FIG. 1 is a perspective view of the mohawk guide embodiment.
Figure 2:
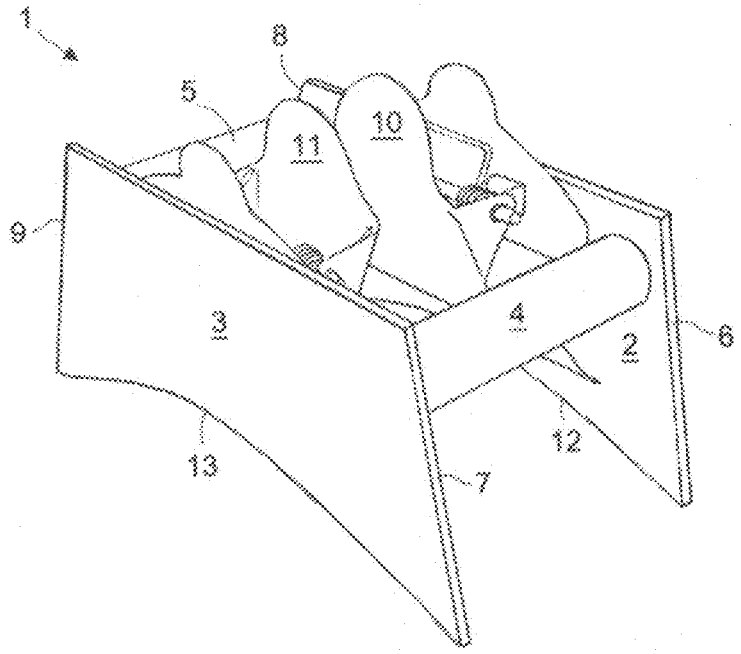
FIG. 2 is a perspective view of the mohawk guide embodiment.
Figure 3:
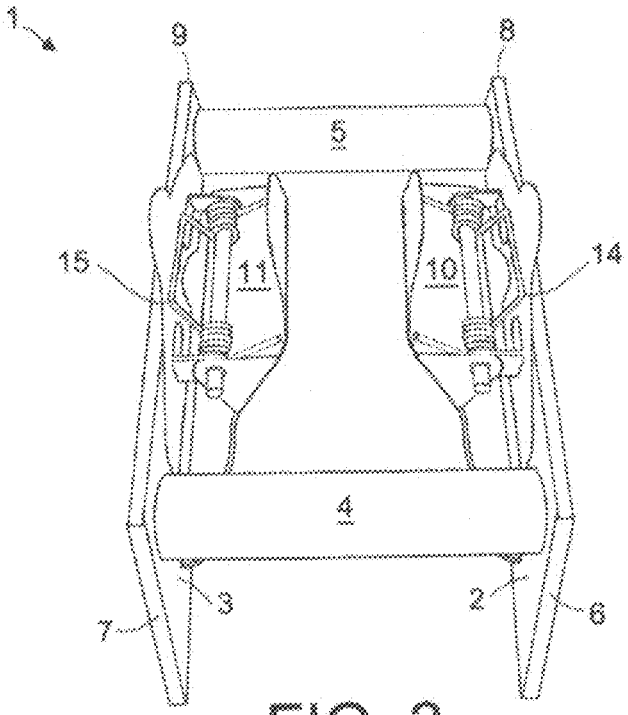
FIG. 3 is a front elevated perspective view of the mohawk guide embodiment.
Figure 4:
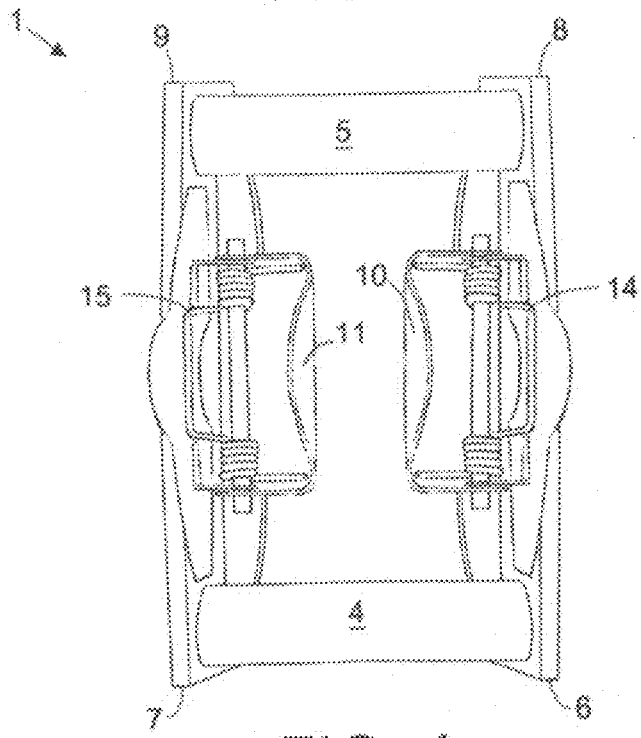
FIG. 4 is a top perspective view of the mohawk guide embodiment.
Figure 5:
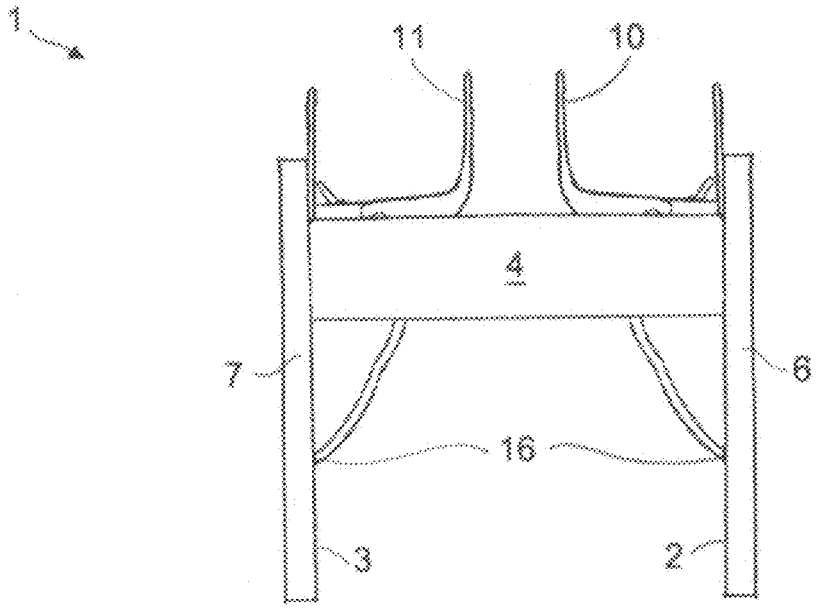
FIG. 5 is a front view of the mohawk guide embodiment with the clips in the closed position.
Figure 6:
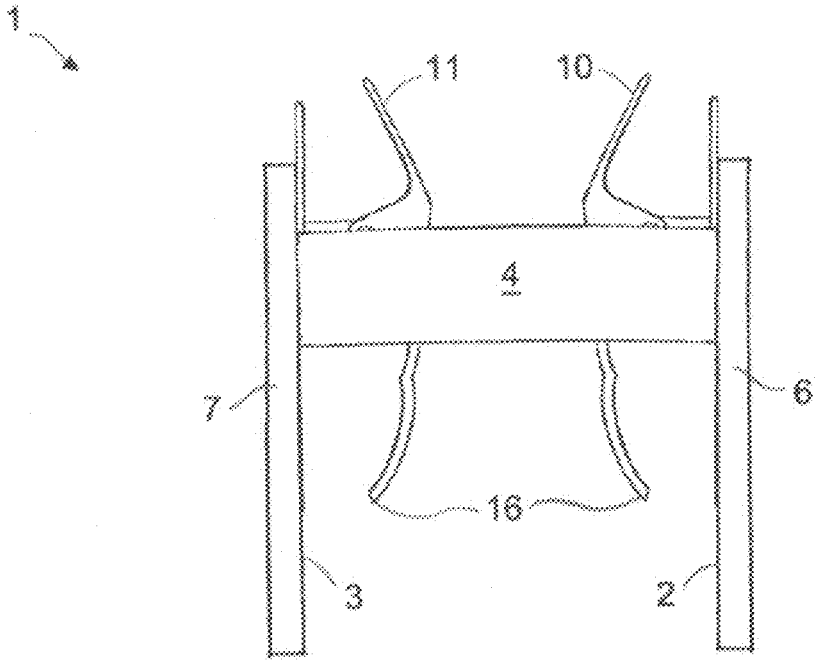
FIG. 6 is a front view of the mohawk guide embodiment with the clips open.
Figure 7:
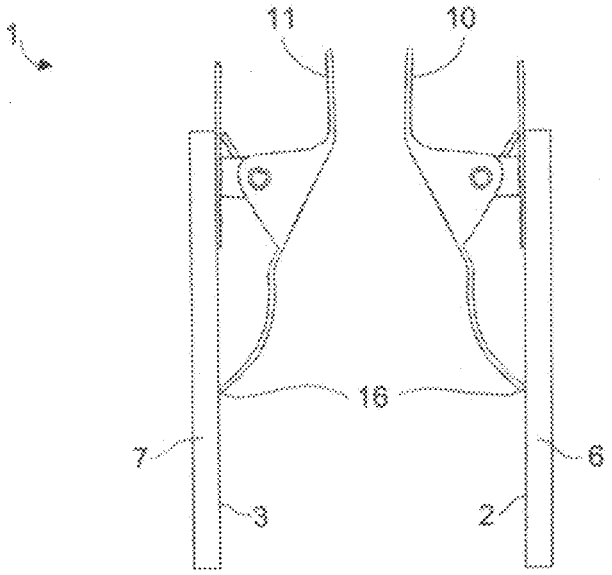
FIG. 7 is an front view of the mohawk guide embodiment shown without the spacers/connecting pieces.
Figure 8:
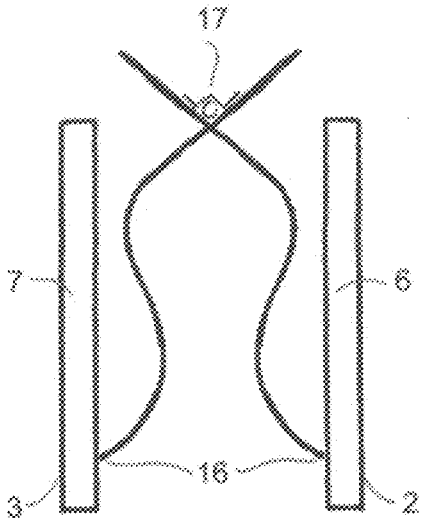
FIG. 8 is an front view of the mohawk guide embodiment envisioned for one handed operation shown with the clips in the closed position and without the spacers/connecting pieces.
Figure 9:
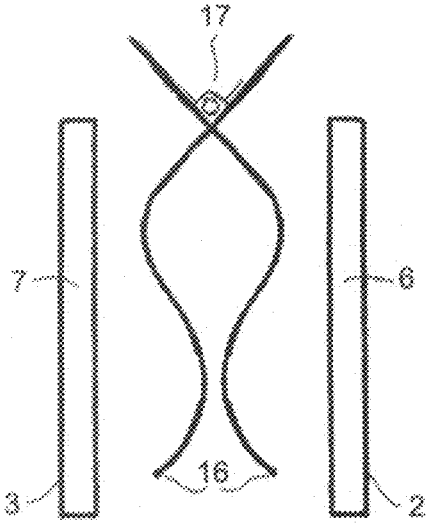
FIG. 9 is an front view of the mohawk guide embodiment envisioned for one handed operation shown with the clips open and without the spacers/connecting pieces.
Figure 10:
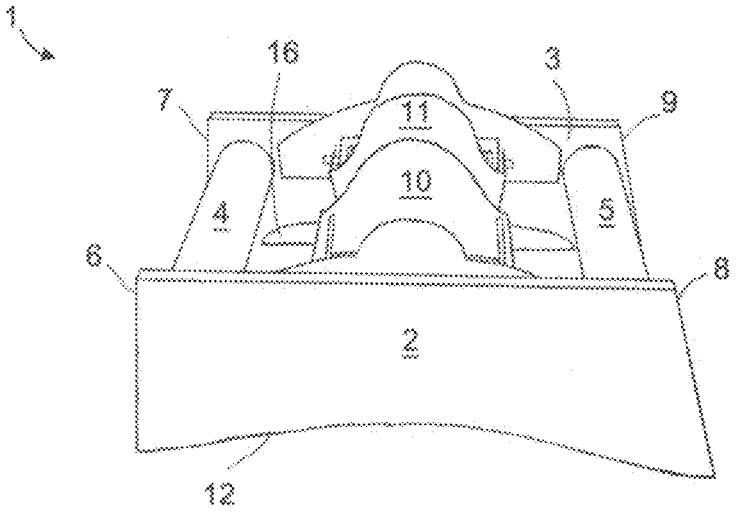
FIG. 10 is an elevated right side perspective view of the mohawk guide embodiment.
Figure 11:
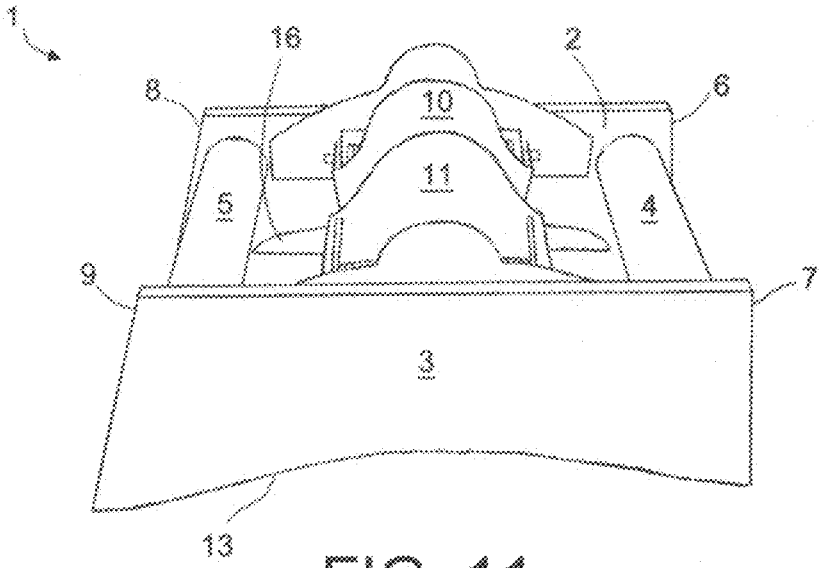
FIG. 11 is an elevated left side perspective view of the mohawk guide embodiment.
Figure 12:
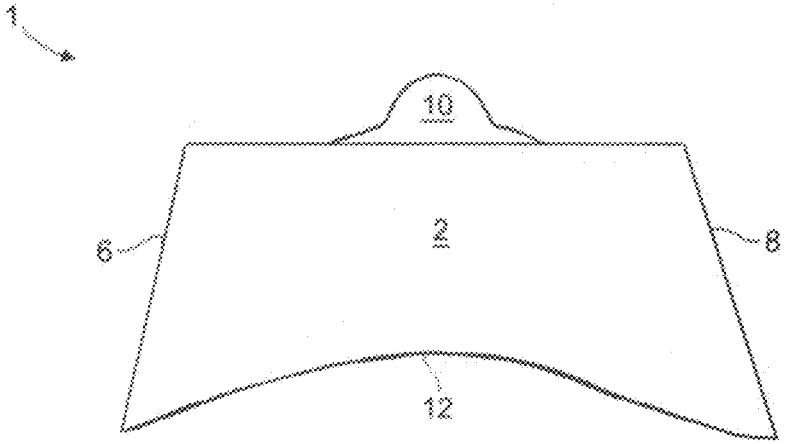
FIG. 12 is a right side view of the mohawk guide embodiment.
Figure 13:
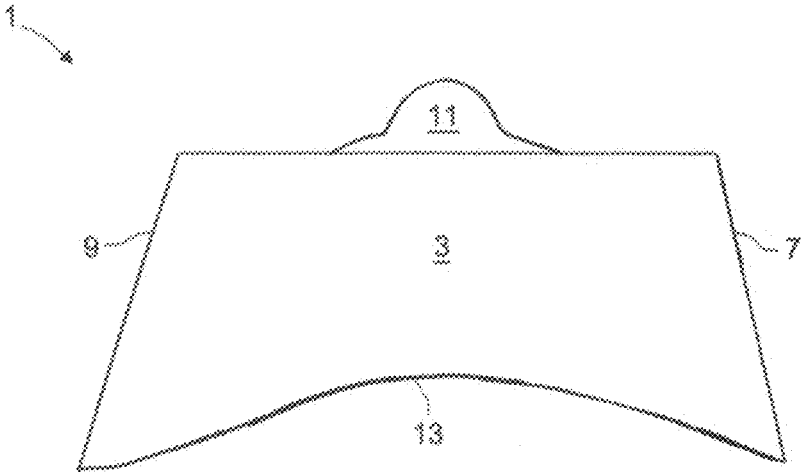
FIG. 13 is a left side view of the mohawk guide embodiment.

Various embodiments will be described more fully hereinafter. The invention is defined by the claims, may be embodied in many different forms, and should not be construed as limited to the embodiments set forth herein; rather, these embodiments are provided so that this disclosure will be thorough and complete, and will fully convey enabling disclosure to those skilled in the art. As used in this specification and the claims, the singular forms "a," "an," and "the" include plural referents unless the context clearly dictates otherwise. Embodiments are described with reference to the drawings in which like elements generally are referred to by like numerals. The relationship and functioning of the various elements of the embodiments may better be understood by reference to the following detailed description. However, embodiments are not limited to those illustrated in the drawings. It should be understood that the drawings are not necessarily to scale, and in certain instances details may have been omitted that are not necessary for an understanding of embodiments disclosed herein, such as—for example—conventional fabrication and assembly.

A perspective view of the mohawk guide 1 is shown in FIG. 1, which mohawk guide may best be understood with reference to the structural and function features described below and shown in FIGS. 1-16. The mohawk guide 1 generally includes two side pieces 2 and 3, two adjustable spacers/connectors 4 and 5, and two clips 10 and 11 that function to hold the mohawk guide to ones head by gripping the hair in between the bottom clip edges 16 and the inner surfaces of the two side pieces 2 and 3.

The side pieces 2 and 3, spacers 4 and 5, and clips 10 and 11 of the mohawk guide 1 may be constructed of metallic and nonmetallic materials. The preferred embodiment of the side pieces 2 and 3, spacers 4 and 5 and clips 10 and 11 preferably are made of a nonmetallic material that is suitable for injection molding. I envision metallic spring(s) 14 and 15 will be utilized for the clips 10 and 11 to function.

The mohawk guide 1 includes a front end 6 and 7, a back end 8 and 9, two side pieces 2 and 3, two clips 10 and 11, and two spacers/connecting pieces 4 and 5. The outer surfaces of the two side pieces 2 and 3 serve to prevent the hair within the two side pieces 2 and 3 (the hair that will become the mohawk) from being cut.

The bottoms 12 and 13 of the two side pieces 2 and 3 are contoured so the mohawk guide 1 better follows the contour of the human head. These bottom contours 12 and 13 enable the side pieces 2 and 3 to be attached very close to ones scalp. I envision the bottom edges 16 of the clips 10 and 11 will have a similar contour as bottom edges 12 and 13 of the side pieces 2 and 3, and will be nearly as long as the length of the side pieces 2 and 3. This will make for a more secure attachment which will assist during operation. The back ends 8 and 9 of the side pieces 2 and 3 may flare out slightly so the user of the mohawk guide 1 can better sense when they are approaching the end of the guide which may help prevent the user from accidentally cutting hair behind the guide. An outward flare may serve to funnel hair into the middle of the guide (hair to become the mohawk) to help prevent one from cutting hair that they don't want to cut.

The width of the spacers/connectors 4 and 5, along with the combined thickness of the side pieces 2 and 3, will determine the approximate width of the mohawk. I envision the spacers 4 and 5 will be adjustable which will allow the mohawk guide 1 to create mohawks of different thicknesses. This can be accomplished by having different length spacers and interchanging them, having adjustable pin and rod spacers, having adjustable screw spacers and/or numerous other configurations. I envision the mohawk guide 1 will (through the use of adjustable spacers 4 and 5) be able to create mohawks from approximately 1.5 inches to 4 inches thick.

I envision the clips 10 and 11 will be spring loaded although there are numerous other mechanisms to make the clips 10 and 11 function. The mohawk guide 1 has the clips 10 and 11 attached to the side pieces 2 and 3, which provides more space in the middle of the guide for hair to go through and provides easier access to said clips during operation but requires the user to use two hands during operation. I envision a mohawk guide embodiment that has a clip(s) 17 in the middle of the guide that operates both gripping edges 16 so it could be operated with one hand. (Shown in FIGS. 8 and 9)

Operation

Figure 14:
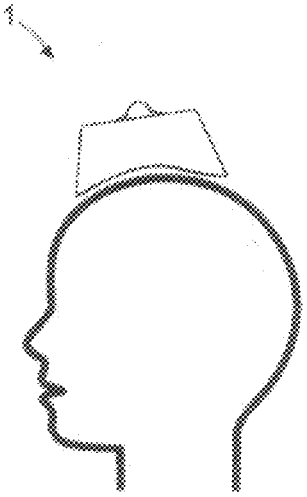
FIGS. 14-16 show a method of use by illustrating the mohawk guide embodiment of FIG. 1 in a diagrammatic longitudinal section view through successive steps of a method of use.
Figure 15:
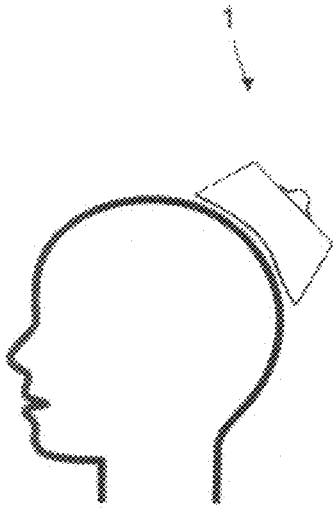
Figure 16:
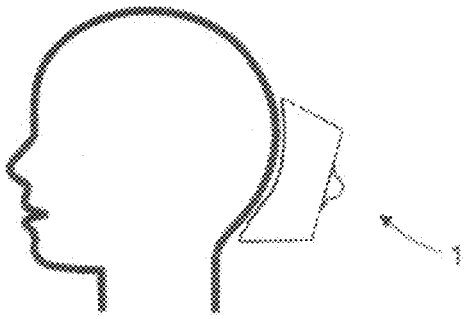

A method of use as described herein may be understood with reference to FIGS. 14-16.

As shown in FIG. 14, the mohawk guide 1 placed with the front of the guide 6 and 7 at the start of ones hairline. The mohawk guide 1 is generally slid through ones hair with the clips 10 and 11 manually held open by squeezing the top of the clips 10 and 11 together. The mohawk guide 1 could be placed into position from above as well. The clips 10 and 11 act as the mohawk guides handle during placement. When the guide is placed where desired the user releases the clips 10 and 11 which causes the clips 10 and 11 to close via the tension of the springs 14 and 15. The edges 16 of the clips 10 and 11 grip the users hair and secures the mohawk guide 1 to the users head. The hair is gripped between the bottom edges 16 of the clips 10 and 11 and the inner surfaces of the side pieces 2 and 3 respectively. The user then cuts the hair on either side of the mohawk guide 1. I envision the outer surfaces of the side pieces 2 and 3 will be flush so the users hand and/or hair cutting implement can better access the hair nearest the outer surfaces of the mohawk guide 1.

As shown in FIG. 15, after the first step is completed the mohawk guide 1 is slid with the clips 10 and 11 held open until the front of the front of the guide 6 and 7 are approximately where the end of the guide 8 and 9 were for the first step. The correct placement is clearly apparent because the hair on either side of the newly created/trimmed mohawk is cut lower. The user then releases the clips 10 and 11 at the desired location and the clips 10 and 11 close to grip the hair and secure the mohawk guide 1. The user then cuts the hair on either side of the mohawk guide 1.

As shown in FIG. 16, after the second step is completed the mohawk guide 1 is slid with the clips 10 and 11 held open until the front of the guide 6 and 7 are approximately where the end of the guide 8 and 9 were for the second step. The fact that the mohawk guide 1 is aligned before cutting with the mohawk segments created by the pervious step(s) assists in creating a straight mohawk. The hair on either side of the mohawk guide is then cut. This process is repeated until the entire mohawk is completed. (generally to the hairline at the back of ones head) The process generally takes three to four steps depending on the size/shape of the head. At the end of the process the user should have a uniformly wide and straight mohawk.

Those of skill in the art will appreciate that embodiments not expressly illustrated herein may be practiced within the scope of the claims, including that features described herein for different embodiments may be combined with each other and/or with currently-known or future-developed technologies while remaining within the scope of the claims. Although specific terms are employed herein, they are used in a generic and descriptive sense only and not for purposes of limitation. It is therefore intended that the foregoing detailed description be regarded as illustrative rather than limiting. And, it should be understood that the following claims, including all equivalents, are intended to define the spirit and scope of this invention. Furthermore, the advantages described above are not necessarily the only advantages of the invention, and it is not necessarily expected that all of the described advantages will be achieved with every embodiment.

I claim:

1. A mohawk hair cutting guide comprising:

two generally vertical side pieces that are substantially rigid and planar with a front edge, a rear edge, a top edge, and a contoured bottom edge extending across the length of the side pieces;

wherein the outer contour of the bottoms of the side pieces are configured to closely follow the outer contour of the human head as the mohawk guide is moved during operation, generally along the middle of head, from the start of hairline generally at the top of the forehead to the end of the hairline generally to the nape of the neck;

two clips that are each attached to one of the two side pieces, with the top of the clips used for operation above the top edges of the side pieces, the bottom edges of the clips rest slightly above the bottom contour edge of the side pieces while closed;

the clips are configured to be manually opened via compressing the tops of the clips while the mohawk guide is being moved and to close when released thereby securing the mohawk guide to ones head by gripping the hair in between the clips bottom edges and the inner surfaces of the side pieces; and two adjustable spacers that serve to connect the two side pieces so they are generally parallel and have an even width, which serves to determine the eventual width of the mohawk to be created.

2. The mohawk hair cutting guide of claim 1, wherein the outer surfaces of the two side pieces of the mohawk guide are generally flat and provide a guide along which a hair cutting implement can follow while cutting hair; and wherein the outer surfaces of the two side pieces serve to prevent the hair in between the two side pieces from being cut.

3. The mohawk hair cutting guide of claim 1, wherein the inner surfaces of the two side pieces of the mohawk guide are generally flat and provide surfaces for the clips, and adjustable spacers to be attached, and provide surfaces which enable the bottom edges of the clips to grip the hair in between the bottom edges of the clips and inner surfaces of the two side pieces when the clips of the guide are engaged and being utilized to secure the mohawk guide to ones head.

4. The mohawk hair cutting guide of claim 1, wherein the clips, spacers, and the bottom clip edges that grip the hair during operation are all contained in between the outer surfaces of the two side pieces.

5. The mohawk hair cutting guide of claim 1, wherein the two side pieces and clips are generally vertically oriented and thin which assists the mohawk guide in sliding through ones hair with little resistance while being positioned before cutting and in providing more space for the hair in between the two side walls that will become the mohawk during both positioning and the cutting process.

6. A method using the mohawk guide of claim 1, the method comprising steps of:

selecting the desired width of the mohawk to be created and adjusting the two mohawk guide spacers accordingly and connecting the two side pieces together via the adjustable spacers;

positioning the mohawk guide, generally by sliding the guide through ones hair with the bottom edges of the clips open, so the front of the mohawk guide is positioned at the approximate start of ones hairline;

releasing the tops of the clips, which had been used as the handle during placement as well as to open the bottom edges of the clips, to close the clips via spring mechanism and thereby grip the hair located in between the bottom clip edges and the inner surfaces of the two side pieces to secure the mohawk guide to ones head;

the hair on either side of the mohawk guide is then cut using the outer surfaces of the two side pieces a guide for the cutting implement which will help prevent the hair in between the two side pieces that will become the mohawk from being cut thus creating a mohawk type hairstyle;

after cutting the hair during the first step the clips are opened to slide the mohawk guide back so the front of the guide is at approximately where the end of the guide was during the previous step before the cutting process is repeated; and this process is repeated until the entire mohawk is completed and/or the desired mohawk type hairstyle is achieved, after which the clips are opened releasing the gripped hair and the mohawk guide is completely removed from ones head and the process is completed.

* * * * *